US007532849B2

(12) United States Patent
Akiba et al.

(10) Patent No.: US 7,532,849 B2
(45) Date of Patent: May 12, 2009

(54) CLEANING DEVICE FOR REMOVING TONER FROM AN IMAGE BEARING MEMBER

(75) Inventors: Yasushi Akiba, Kanagawa (JP); Yosuke Saito, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 410 days.

(21) Appl. No.: 11/480,880

(22) Filed: Jul. 6, 2006

(65) Prior Publication Data

US 2007/0009293 A1 Jan. 11, 2007

(30) Foreign Application Priority Data

Jul. 6, 2005 (JP) ..... 2005-197068

(51) Int. Cl.
*G03G 21/00* (2006.01)

(52) U.S. Cl. ..... 399/345; 399/350

(58) Field of Classification Search ..... 399/345, 399/346, 350, 351

See application file for complete search history.

(56) References Cited

U.S. PATENT DOCUMENTS

| | | | | |
|---|---|---|---|---|
| 4,595,280 | A * | 6/1986 | Tanzawa et al. | 399/345 |
| 4,702,591 | A * | 10/1987 | Tsuda et al. | 399/345 |
| 4,969,015 | A | 11/1990 | Sanpe | |
| 5,107,303 | A * | 4/1992 | Miyamoto et al. | 399/350 |
| 5,396,319 | A * | 3/1995 | Tokuhashi et al. | 399/351 |
| 6,868,252 | B2 | 3/2005 | Akiba | |
| 6,925,282 | B2 * | 8/2005 | Drawe et al. | 399/350 |
| 7,251,448 | B2 * | 7/2007 | Pozniakas et al. | 399/350 |

FOREIGN PATENT DOCUMENTS

| | | |
|---|---|---|
| JP | 5-323833 | 12/1993 |
| JP | 2001-296781 | 10/2001 |
| JP | 2003-208068 | 7/2003 |
| JP | 2004-117465 | 4/2004 |

* cited by examiner

*Primary Examiner*—William J Royer
(74) *Attorney, Agent, or Firm*—Oblon, Spivak, McClelland, Maier & Neustadt, P.C.

(57) ABSTRACT

A cleaning device includes a cleaning blade configured to remove toner adhered on a surface of an image bearing member, and a contact and separation mechanism configured to contact and separate the cleaning blade to and from the surface of the image bearing member, the contact and separation mechanism including a first force providing member configured to provide a first force to contact the cleaning blade onto the surface of the image bearing member, a second force providing member configured to provide a second force to separate the cleaning blade from the surface of the image bearing member, and a third force providing member configured to provide a third force to change an amount of the second force exerted by the second force providing member.

19 Claims, 4 Drawing Sheets

CLEANING DEVICE FOR REMOVING TONER FROM AN IMAGE BEARING MEMBER

CROSS REFERENCE TO RELATED APPLICATIONS

The present application claims priority to Japanese patent application no. 2005-197068, filed in, the Japan Patent Office on Jul. 6, 2005, the disclosure of which is incorporated by reference herein in its entirety.

BACKGROUND OF THE INVENTION

1. Field of the Invention

The present invention relates to an image forming method and apparatus of effectively removing toner. More particularly, the present invention relates to a cleaning device for removing toner from an image bearing member, an electrophotographic image forming apparatus including the cleaning device, and a method of controlling a cleaning operation for removing toner remaining on an image bearing member in the image forming apparatus.

2. Discussion of the Related Art

In general, background image forming apparatuses transfer a toner image formed on a surface of an image bearing member or a photoconductive element onto a primary transfer member or a recording medium. After the transfer operation has been completed, the background image forming apparatuses remove toner remaining on a surface of the image bearing member by a cleaning device employing a cleaning member.

Known cleaning devices use a cleaning blade as a cleaning member. The cleaning member is held in contact with the surface of the image bearing member so that the cleaning member can remove the toner remaining on the surface of the image bearing member.

To intermittently perform a cleaning operation with respect to the image bearing member, the cleaning device having the above-described cleaning member may employ a contact and separation mechanism so that the cleaning member can be separated from the image bearing member during a period in which the cleaning device is not in a cleaning operation. With such contact and separation mechanism, the cleaning device can effectively increase the life of the image bearing member and that of the cleaning member.

One known image forming apparatus with the above-described cleaning device employs a polishing device to prevent an image bearing member from deterioration, for example toner filming due to adhesion. Specifically, in addition to a cleaning device constantly removing residual toner from a surface of an image bearing member, the image forming apparatus includes a polishing device with a polishing blade and a driving unit that operates the polishing blade during a non-image forming operation.

A different background image forming apparatus is known to have a technique that can prevent the occurrence of a toner filming on an image bearing member for a long period of time and before the production of blurred images and the occurrence of image deletion. The background image forming apparatus employs a cleaning member including a cleaning blade with a polishing agent to remove residual toner from a surface of the image bearing member. The cleaning blade is held in contact with the surface of the image bearing member via the polishing agent, and the surface of the image bearing member is formed with a material having a hardness such that such surface cannot be damaged by the cleaning blade.

Further, a different background image forming apparatus using spherical and small toner particles is known to include a technique in which a cleaning device is provided to remove remaining toner and foreign material on the surface of the image bearing member and to maintain a cleaning ability for a long period of time. The cleaning device includes first and second cleaning blades in order from an upstream side of a rotational direction of the image bearing member. The second cleaning blade has a double-layered structure including a blade body layer and a layer having particles of the polishing agent.

The above-described background image forming apparatuses can, however, damage a surface of an image bearing member through cleaning operations performed by a cleaning device.

In recent years, transfer sheets include calcium carbonate for increasing its degree of whiteness, and various additives are added to the developer or toner for stabilizing the characteristics of toner. Since a great number of the components or additives is smaller in size and greater in hardness than those used before, a cleaning blade serving as a cleaning member is designed to be contacted with and separated from a surface of the image bearing member. When the smaller and harder components or additives included in toner and paper dust adhere to the edge of the cleaning blade of the cleaning device, the surface of the image bearing member can be damaged. When the surface of the image bearing member has scratches and damage, the surface potential of the damaged area of the surface thereof may become unstable, which may result in the production of defective images due to change in electrical potential.

SUMMARY OF THE INVENTION

Exemplary aspects of the present invention have been made in view of the above-described circumstances.

Exemplary aspects of the present invention provide a novel cleaning device that can efficiently remove toner.

Other exemplary aspects of the present invention provide a novel image forming apparatus that can include the above-described novel cleaning device therein.

Other exemplary aspects of the present invention provide a method of controlling a cleaning operation for removing toner by the above-described novel cleaning device that can be included in the above-described image forming apparatus.

In one exemplary embodiment, a novel cleaning device includes a cleaning blade configured to remove toner adhered on a surface of an image bearing member, and a contact and separation mechanism configured to contact and separate the cleaning blade to and from the surface of the image bearing member. The contact and separation mechanism includes a first force providing member configured to provide a first force to contact the cleaning blade onto the surface of the image bearing member, a second force providing member configured to provide a second force to separate the cleaning blade from the surface of the image bearing member, and a third force providing member configured to provide a third force to change an amount of the second force exerted by the second force providing member.

The novel cleaning device may further include a first supporting member having a rotation axis and configured to support the cleaning blade. The cleaning blade may be configured to angularly move about the rotation axis of the first supporting member.

The novel cleaning device may further include a contact member configured to receive the first force exerted by the first force providing member, a first separation member configured to receive the second force exerted by the second force providing member, and a second separation member configured to receive the second force via the first separation member. The contact and separation members may have a relationship of L2>L1, where "L" represents a distance from the rotation axis to a point of action of the contact member to which the first force is applied and "L2" represents a distance from the rotation axis to a point of action of the second separation member to which the second force is applied.

The first separation member may be configured to receive the third force exerted by the third force providing member.

The first force providing member may include a compression spring, the second force providing member may include an extension spring, and the third force providing member may include a solenoid.

When the cleaning blade is moved toward the image bearing member to contact with the surface of the image bearing member, the solenoid may be applied with a voltage to gradually reduce the amount of the second force.

The novel cleaning device may further include a second supporting member having a shaft configured to connect the second and third force providing members with each other via the shaft thereof.

The cleaning blade may include a polishing member.

The cleaning blade may be configured to contact a leading edge thereof with the surface of the image bearing member in a direction following a rotation of the image bearing member.

Further, in one exemplary embodiment, a novel image forming apparatus includes an image bearing member configured to bear an image on a surface thereof, and a cleaning device configured to clean the image bearing member and including a cleaning blade configured to remove toner adhered on a surface of the image bearing member and a contact and separation mechanism configured to contact and separate the cleaning blade to and from the surface of the image bearing member. The contact and separation mechanism includes a first force providing member configured to provide a first force to contact the cleaning blade onto the surface of the image bearing member, a second force providing member configured to provide a second force to separate the cleaning blade from the surface of the image bearing member, and a third force providing member configured to provide a third force to change an amount of the second force exerted by the second force providing member.

Further, in one exemplary embodiment, a novel method of controlling a cleaning operation includes providing a first force exerted by a first force providing member and a second force exerted by a second force providing member so that a cleaning blade is separated from a surface of an image bearing member, providing a third force exerted by a third force providing member so that the amount of the second force is reduced to gradually contact the cleaning blade with the surface of the image bearing member, performing the cleaning operation for a predetermined period of time, and terminating the third force so that the cleaning blade is separated from the surface of the image bearing member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
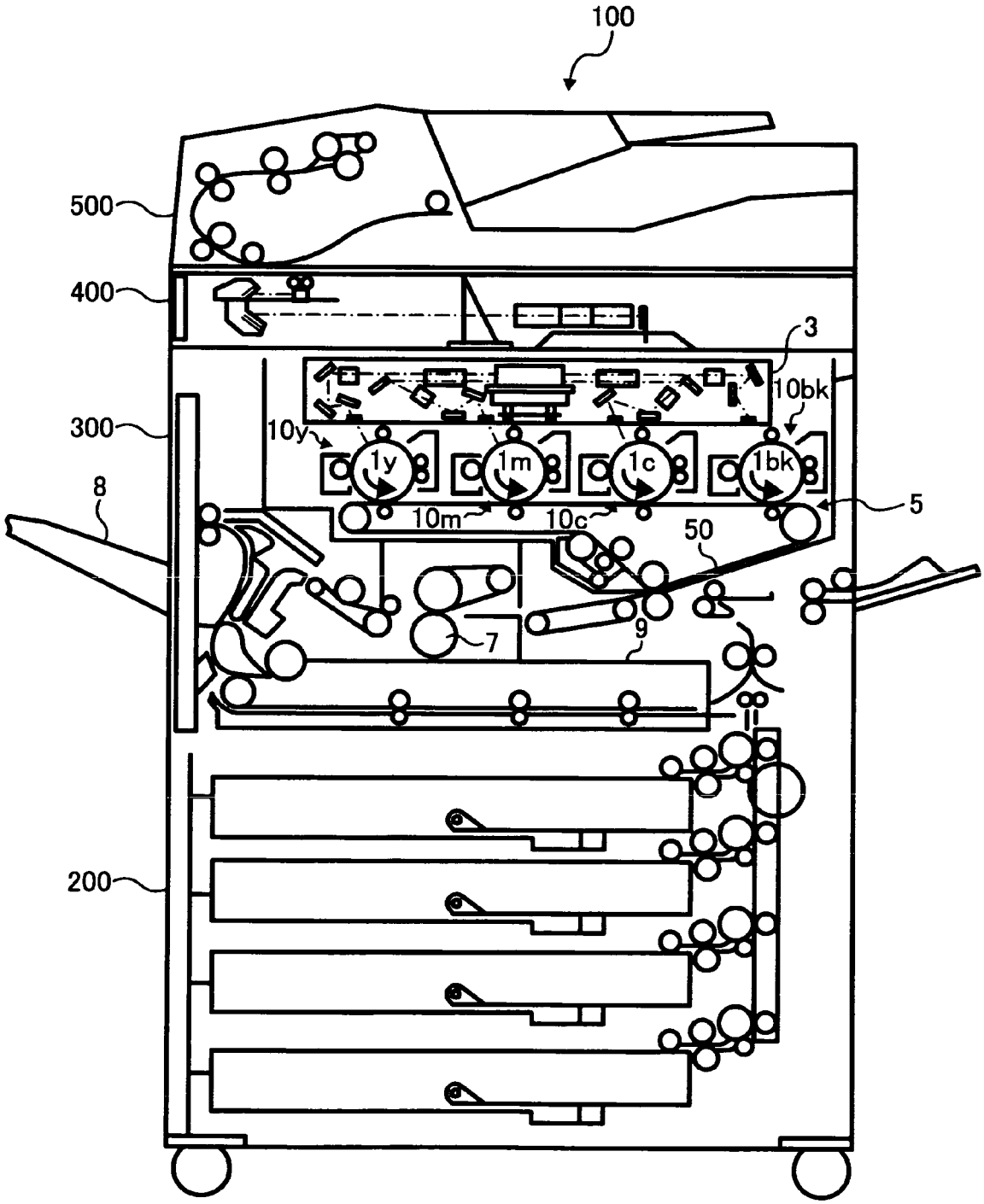
FIG. 1 is a schematic structure of an image forming apparatus according to one exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 2:
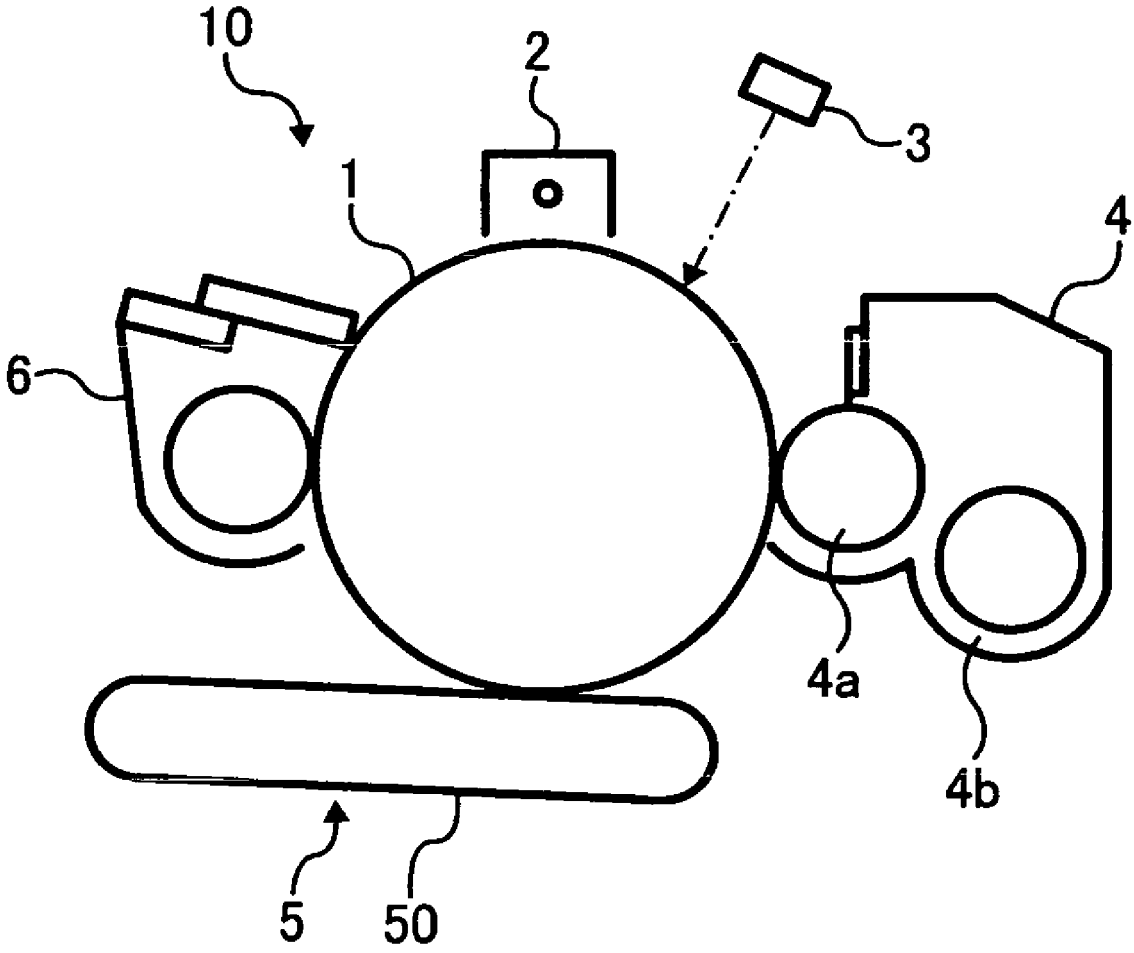
FIG. 2 is an enlarged view of an image forming unit included in the image forming apparatus of FIG. 1.

Referring to FIGS. 1 and 2, a schematic structure of a full color image forming apparatus 100 according to an exemplary embodiment of the present invention is described. Hereinafter, the entire color image forming apparatus 100 is referred to as an "image forming apparatus 100."

In FIG. 1, the image forming apparatus 100 includes a sheet feeding mechanism 200, an image forming mechanism 300, an image reading mechanism 400, and a document conveying mechanism 500.

The sheet feeding mechanism 200 feeds recording media including a recording medium and conveys the recording medium toward the image forming mechanism 300.

The image forming mechanism 300 forms a color image to transfer onto a surface of the recording medium.

The image reading mechanism 400 reads or scans image data from a document.

The document conveying mechanism 500 is an automatic document feeder that feeds a document to scan the image on the document by the image reading mechanism 400.

Now, the image forming mechanism 300 mainly includes an optical writing device 3, a transfer device 5, a fixing device 7, and four image forming units 10y, 10m, 10c, and 10bk.

The image forming units 10y, 10m, 10c, and 10bk include respective consumable image forming components to perform image forming operations for producing respective toner images with toners of different colors of yellow (y), magenta (m), cyan (c), and black (bk). The image forming units 10y, 10m, 10c , and 10bk are separately arranged at a horizontal position with respect to the image forming apparatus 100 and are detachably provided to the image forming apparatus 100 so that each of the units can be replaced once at an end of its useful life.

The image forming units 10y, 10m, 10c, and 10bk include drum-shaped photoconductive drums or photoconductive drums 1y, 1m, 1c, and 1bk, respectively, corresponding to the colors of images. Each of the photoconductive drums 1y, 1m, 1c, and 1bk is surrounded by a plurality of image components.

The optical writing device 3 of FIG. 1 is a part of the image forming mechanism 300, and receives image data read by the image reading mechanism 400 or sent from an external computer (not shown). The optical writing device 3 then causes, for example, a polygon mirror (not shown) that is driven by a polygon motor (not shown) to scan and deflect laser beams. According to the image data signals corresponding to different colors of toner for the image forming units 10y, 10m, 10c, and 10bk, the optical writing device 3 emits the laser light beams towards the respective photoconductive drums 1y, 1m, 1c, and 1bk to irradiate respective surfaces of the photoconductive drums 1y, 1m, 1c, and 1bk so that respective electrostatic latent images are formed on the respective surfaces of the photoconductive drums 1y, 1m, 1c, and 1bk.

The transfer device 5 is arranged below the image forming units 10y, 10m, 10c, and 10bk. The transfer device 5 includes an intermediate transfer belt 50.

The intermediate transfer belt 50 forms an endless belt spanned around or extending over a plurality of supporting rollers. The intermediate transfer belt 50 is held in contact with respective primary transfer rollers corresponding to the photoconductive drums 1y, 1c, 1m, and 1bk to form respective primary transfer nips between each of the photoconductive drums 1y, 1m, 1c, and 1bk and the respective corresponding primary transfer rollers.

The intermediate transfer belt 50 sequentially receives respective toner images formed on the respective surfaces of the photoconductive drums 1y, 1m, 1c, and 1bk in an overlying manner into an overlaid toner image. The intermediate transfer belt 50 then transfers the overlaid toner image onto a recording medium.

The structure of the transfer device 5 is not limited to the above-described structure employed in the image forming apparatus 100 according to the exemplary embodiment of the present invention. Alternatively to the above-described intermediate transfer belt 50, the transfer device 5 of the image forming apparatus 100 according to the exemplary embodiment of the present invention can include a sheet conveying belt on which a recording medium is conveyed to directly receive toner images thereon from the photoconductive drums 1y, 1m, 1c, and 1bk in a sequentially overlaying manner.

The fixing device 7 includes a belt extended by a roller having a heater therein, for example a halogen lamp, and a pressure roller. A recording medium having a toner image thereon is pressed at the nip portion formed by the belt and pressure roller so as to fix the toner image to the recording medium by applying heat and pressure.

The structure of the fixing device 7 is not limited to the above-described structure employed in the image forming apparatus 100 according to the exemplary embodiment of the present invention. Alternatively to the above-described belt and pressure roller, the fixing device 7 of the image forming apparatus 100 according to the exemplary embodiment of the present invention can include a pair of rollers or a pair of belts.

The image forming mechanism 300 further includes a sheet discharging tray 8 and a sheet reverse unit 9.

The sheet discharging tray 8 receives the recording medium fixed by the fixing device 7.

The sheet reverse unit 9 reverses the recording medium having an unfixed toner image on one surface thereof and feeds the recording medium back to a sheet conveying path so that another toner image can be formed on the other side of the recording medium.

FIG. 2 shows an enlarged view of an image forming unit 10, representing one of the image forming units 10y, 10m, 10c, and 10bk, for producing a single color toner image.

The photoconductive drums 1y, 1m, 1c, and 1bk can include, for example, amorphous metal including photoconductivity, such as amorphous silicon, amorphous selenium and so forth or organic compound such as bisazo pigments, phthalocyanine pigments and so forth. Considering environmental issues and downstream processing, an organic photoconductive drum is preferably used in the image forming apparatus 100 according to the exemplary embodiment of the present invention.

Since the four units of the image forming units 10y, 10m, 10c, and 10bk have similar structures and functions, except that respective toners are of different colors, which are yellow, cyan, magenta, and black toners, the discussion below uses reference numerals for specifying components of the image forming apparatus 100 without suffixes of colors such as y, m, c, and bk.

As previously described, the photoconductive drum 1 has the image forming components around it. The image forming components included in the image forming unit 10 of FIG. 2 are a charging device 2, a developing device 4, a cleaning device 6 and so forth.

The charging device 2 of the image forming apparatus 100 according to the exemplary embodiment of the present invention employs a roller charging system. However, the charging system of the charging device 2 is not limited to the above-described system. Alternatively to the above-described roller charging system, the charging device 2 of the image forming apparatus 100 according to the exemplary embodiment of the present invention can employ any of a corona charging system, a brush charging system, and a blade charging system.

The charging device 2 applies a high voltage to a charging roller (not shown) to cause a corona discharge between the charging device 2 and the photoconductive drum 1 so as to uniformly charge the surface of the photoconductive drum 1.

The developing device 4 includes a developer bearing member 4*a* and a toner accommodating chamber 4*b*.

The toner accommodating chamber 4*b* accommodates toner therein.

The developer bearing member 4*a* includes, for example, the main body thereof and a magnet roller. The main body of the developer bearing member 4*a* is formed by a cylindrical shape having a hollow center and is rotatably fixed in the developer bearing member 4*a*, and bears or carries developer on the surface thereof. The magnet roller is concentrically fixed in the main body of the developer bearing member 4*a*, and magnetically attracts the developer onto the outer surface of the developer bearing member 4*a* to convey.

The developer bearing member 4*a* is formed by a conductive and non-magnetic member, and is connected with a power source (not shown) to apply a development bias. The power source applies a predetermined level of voltage between the developer bearing member 4*a* and the photoconductive drum 1 so that an electric field can be formed on a development area.

A primary transfer unit (not shown) is disposed at the position opposite to or facing the photoconductive drum 1, having the transfer device 5 therebetween. The primary transfer unit transfers a toner image formed on the surface of the photoconductive drum 1 onto the surface of the intermediate transfer belt 50. At this time, a predetermined level of voltage may be applied from an electrode (not shown). This action may form an electric field between the photoconductive drum 1 and the intermediate transfer belt 50, and thereby, the toner image can be electrostatically transferred.

The cleaning device 6 is disposed at a downstream side of the transfer device 5. The cleaning device 6 removes and cleans residual toner remaining on the surface of the photoconductive drum 1 after the toner image has been transferred.

Hereinbelow, operations performed by the image forming apparatus 100 having the above-described structure and functions are described.

The charging device 2 of the image forming unit 10 uniformly charges the surface of the photoconductive drum 1 representing the photoconductive drums 1y, 1m, 1c, and 1bk. The optical writing device 3 emits the laser light beam to irradiate the charged surface of the photoconductive drum 1 serving as an image bearing member. With the above-described operation, an electrostatic latent image is formed on the surface of the photoconductive drum 1.

The developer bearing member 4*a* of the developing device 4 supplies toner contained in the toner accommodating chamber 4*b* to the surface of the photoconductive drum 1 so that the electrostatic latent image formed on the surface of the photoconductive drum 1 can be developed to a toner image.

The respective toner images developed in the image forming units 10y, 10m, 10c, and 10bk are sequentially transferred on the intermediate transfer belt 50 in an overlaid manner. The overlaid toner image is then transferred onto a recording medium conveyed from the sheet feeding mechanism 200.

The recording medium having the overlaid toner image on the surface thereof is conveyed to the fixing device 7 so that the overlaid toner image can be fixed by application of heat and pressure.

The recording medium with the toner image fixed by the fixing device 7 is discharged to the sheet discharging tray 8.

The cleaning device 6 removes residual toner or paper dust on the surface of the photoconductive drum 1 so as to prepare for the next image forming operation.

The above-described operation is identical for the yellow, magenta, cyan, and black toners.

Referring to FIGS. 3A, 3B, 4A, and 4B, schematic structures and functions of the cleaning device 6 according to the exemplary embodiment of the present invention are described.

Figure 3A:
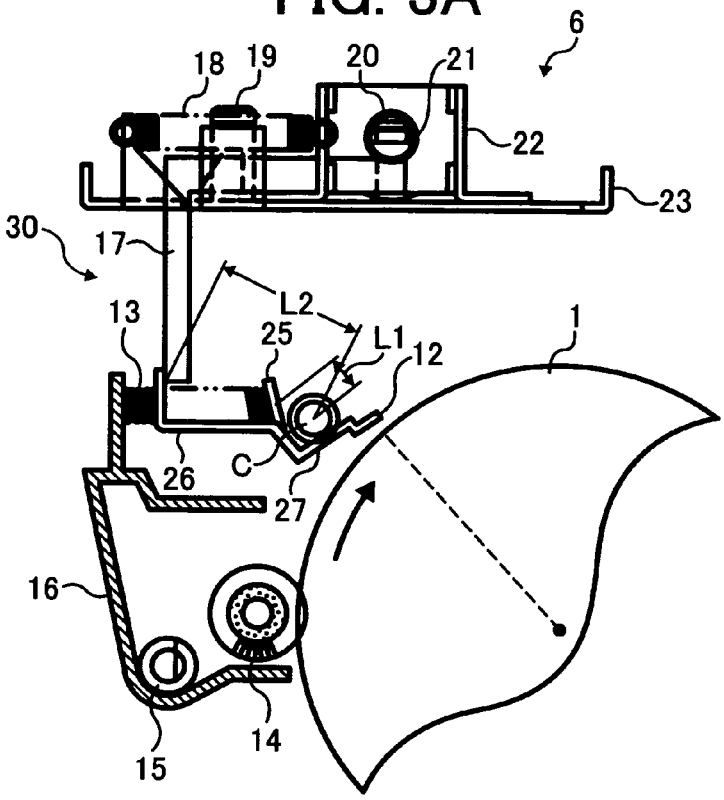
FIGS. 3A and 3B are cross sectional views of a cleaning device, according to the exemplary embodiment of the present invention, included in the image forming unit of FIG. 2.
Figure 3B:
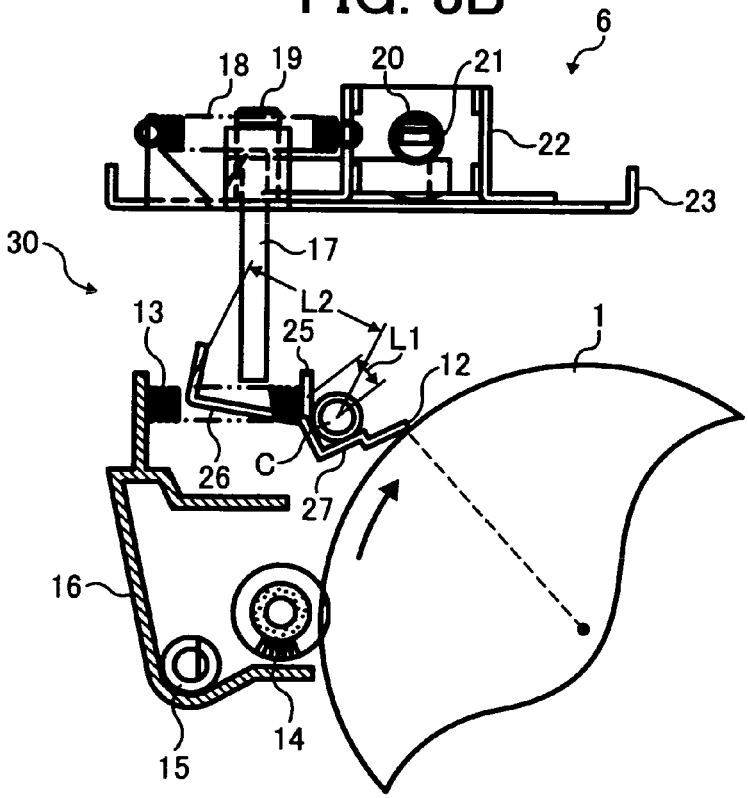
Figure 4A:
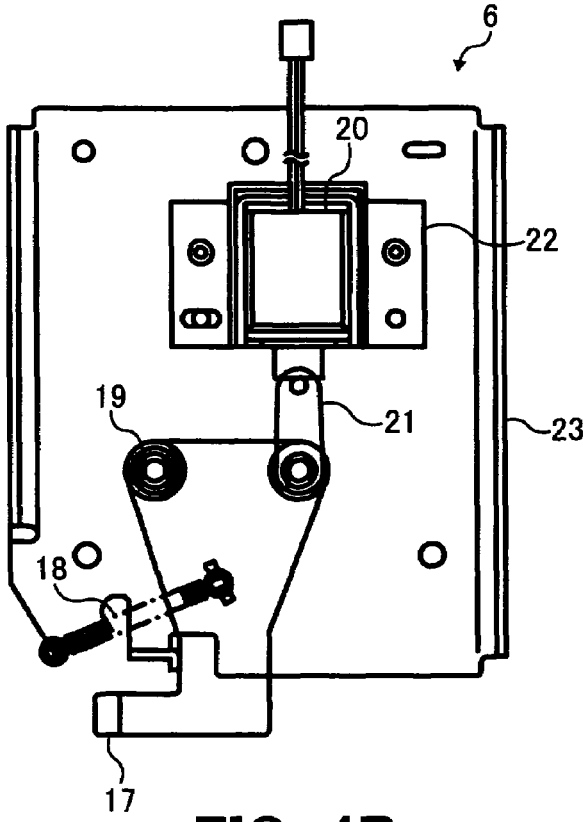
FIGS. 4A and 4B are cross sectional views of the cleaning device of FIGS. 3A and 3B, viewed from a different angle.
Figure 4B:
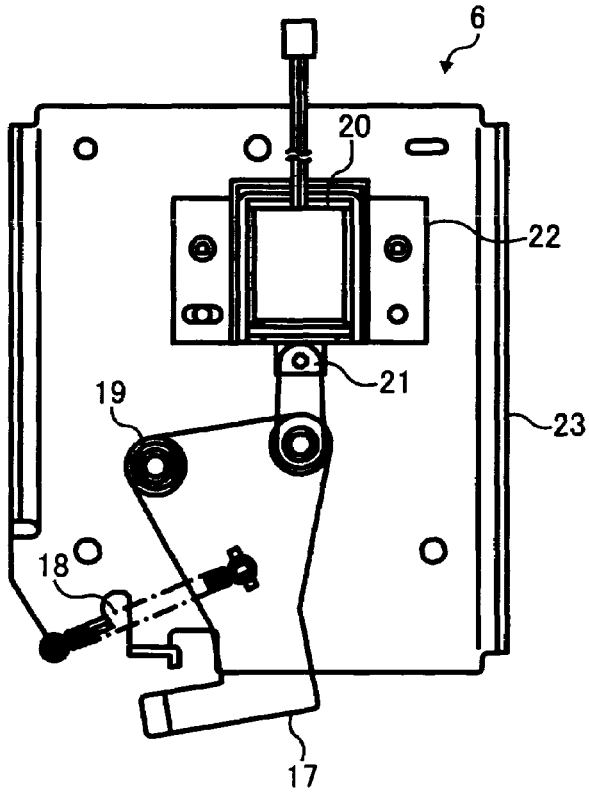

FIGS. 3A and 4A show the position of the components of the cleaning device 6 when the cleaning device 6 is not in a cleaning operation. FIGS. 3B and 4B show the position of the components of the cleaning device 6 when the cleaning device 6 is in a cleaning operation.

Hereinafter, the status of the cleaning device 6 in the cleaning operation is referred to as a "cleaning operation", and the status thereof not in the cleaning operation is referred to as a "non-cleaning operation."

The cleaning device 6 shown in FIGS. 3A and 3B includes a cleaning blade 12, a cleaning case 16, and a blade contact and separation mechanism 30.

The cleaning blade 12 removes residual toner remaining on the surface of the photoconductive drum 1. The details of the cleaning blade 12 will be described later.

The cleaning case 16 includes a fur brush 14 and a toner collection coil 15. The leading edge of the fur brush 14 is held in contact with the surface of the photoconductive drum 1 so as to remove and collect the residual toner.

The blade contact and separation mechanism 30 controls movement of the cleaning blade 12, and includes a compression spring 13, a cleaning blade separation arm 17, an extension spring 18, a pivoted shaft 19, a solenoid 20, a solenoid arm 21, a base 23, a cleaning blade contact member 25, a cleaning blade separation member 26, a cleaning blade supporting member 27 and so forth. The details of the blade contact and separation mechanism 30 will be described later.

The cleaning blade 12 is disposed at one end of the compression spring 13, which will be described later. The cleaning blade 12 is attached to the cleaning case 16 via the compression spring 13 in an angularly movable manner with respect to the photoconductive drum 1. With the above-described structure, the leading edge of the cleaning blade 12 can be disposed opposite to or facing the surface of the photoconductive drum 1. The leading edge of the cleaning blade 12 includes a polishing agent that is exposed to the photoconductive drum 1 so as to contact with the surface of the photoconductive drum 1.

When the cleaning device 6 is in the non-cleaning operation, the cleaning blade 12 stays at a separating position as shown in FIG. 3A and is separated from the photoconductive drum 1.

When the cleaning device 6 is in the cleaning operation for removing residual toner remaining on the surface of the photoconductive drum 1, the cleaning blade 12 is moved to a contacting position as shown in FIG. 3B so that the cleaning blade 12 can contact the surface of the photoconductive drum 1 to remove the residual toner.

The blade contact and separation mechanism 30 performs a contact and separation operation to control the movement of the cleaning blade 12 with respect to the surface of the photoconductive drum 1.

The compression spring 13 serving as a first force providing member is disposed at the top of the cleaning case 16, extending toward the surface of the photoconductive drum 1 in a substantially horizontal manner. The compression spring 13 applies a first pressure force to contact the cleaning blade 12 with the surface of the photoconductive drum 1.

The cleaning blade separation arm 17 serving as a first separation member is disposed at a position above the compression spring 13.

The cleaning blade contact member 25 serving as a contact member has two ends in the vertical direction. One end of the cleaning blade contact member 25 is fixedly mounted on the cleaning blade supporting member 27. The other end of the cleaning blade contact member 25 is disposed at a position away from the center of the cleaning blade supporting member 27 by a distance or length "L1". Hereinafter, the center of the cleaning blade supporting member 27 is referred to as a "rotation axis C." The cleaning blade contact member 25 receives the first pressure force exerted by the compression spring 13 in the vicinity of the other end thereof, which is the point of application of the first pressure force.

The extension spring 18 serving as a second force providing member is mounted to connect the cleaning blade separation arm 17 and the base 23. The extension spring 18 supports the cleaning blade separation arm 17 by exerting a second pressure force to keep the cleaning blade separation arm 17 at the position shown in FIGS. 3A and 4A when the cleaning device 6 is not in the cleaning operation.

The cleaning blade separation arm 17 shown in FIG. 4A has one end portion that is rotatably mounted on the base 23 via the pivoted shaft 19.

The cleaning blade separation arm 17 shown in FIG. 4A, has another end portion adjacent to the above-described end portion rotatably mounted on the base 23 via the pivoted shaft 19. This end portion is linked or connected to the solenoid 20 serving as a third force providing member via the solenoid arm 21 serving as a second supporting member.

The solenoid 20 is fixed onto the base 23 by a bracket 22.

The cleaning blade separation member 26 serving as a second separation member is a L-shaped member having two ends thereof. One end of the cleaning blade separation member 26 is fixedly mounted on the cleaning blade supporting member 27. The other end of the cleaning blade separation member 26 is disposed at a position away from the rotation axis "C" by a distance or length "L2". The cleaning blade separation member 26 receives the second pressure force exerted by the extension spring 18 via the cleaning blade separation arm 17, in the vicinity of the other end thereof, which is the point of application of the second pressure force.

A detailed summary of the function of cleaning blade separation arm 17 will be described later.

The cleaning blade supporting member 27 serves as a first supporting member. The cleaning blade supporting member 27 supports the cleaning blade 12 so as to concentrically rotate the cleaning blade 12 about the rotation axis "C".

As described above, the cleaning blade supporting member 27 supports the cleaning blade 12 so that the cleaning blade 12 can angularly be moved about the rotation axis C of the cleaning blade supporting member 27.

Now, the blade contact and separation mechanism 30 includes the above-described structure that can satisfy a relationship of L2>L1, where "L1" represents the distance from the rotation axis C of the cleaning blade supporting member 27 to the point of application of the cleaning blade contact member 25 to which the first pressure force exerted by the compression spring 13 is applied, and "L2" represents the distance from the rotation axis C of the cleaning blade supporting member 27 to the point of application of the cleaning blade separation member 26 to which the second pressure force exerted by the cleaning blade separation arm 17 is applied.

When the status of the cleaning device 6 is changed to the cleaning operation, a predetermined amount of voltage is applied to the solenoid 20. With the power on of the solenoid 20, the solenoid arm 21 may pull the cleaning blade separation arm 17 to the upward direction of FIG. 4A. This action may cause the cleaning blade separation arm 17 to rotate or move about the pivoted shaft 19 in the counterclockwise direction thereof so as to move to the position as shown in FIG. 4B.

The above-described rotation may cause the leading edge of the cleaning blade separation arm 17 to be moved to the position shown in FIG. 3B while causing the extension spring 18 to be extended as shown in FIG. 4B, With the movement of the cleaning blade separation arm 17 to the position in FIGS. 3B and 4B, the cleaning blade separation member 26 may be disengaged from the cleaning blade separation arm 17. The above-described disengagement may release the second pressure force that has been applied by the extension spring 18 via the cleaning blade separation arm 17 to the cleaning blade supporting member 27, which is the counter force with respect to the compression spring 13.

According to the above-described operations, the amount of the first pressure force exerted by the compression spring 13, which is applied to the point of application of the cleaning blade contact member 25, may become greater than the amount of the second pressure force. The first pressure force can rotate the cleaning blade supporting member 27 in the clockwise direction. Thus, the leading edge of the cleaning blade 12 may come into contact with the surface of the photoconductive drum 1 so as to remove the residual toner remaining on the surface of the photoconductive drum 1.

When the solenoid 20 pulls up the cleaning blade separation arm 17, the third pressure force may gradually be transmitted via the solenoid arm 21 and the pivoted shaft 19 to the cleaning blade separation arm 17. The cleaning blade separation arm 17 also transmits the third pressure force to the cleaning blade separation member 26 and further to the cleaning blade supporting member 27. According to the above-described action, the cleaning blade 12 can come into contact with the surface of the photoconductive drum 1. Thereby, the stress in which the cleaning blade 12 may cause to the surface of the photoconductive drum 1 when contacting the surface of the photoconductive drum 1 can be reduced. This may result in a reduction or prevention of damage to the surface of the photoconductive drum 1, which can further reduce or prevent a defect in image.

The cleaning blade contact member 25 causes the cleaning blade 12 to contact with the surface of the photoconductive drum 1 in a direction the same as the rotation direction of the photoconductive drum 1 or a trailing direction.

Now, the cleaning operations performed by the cleaning device 6 of the image forming apparatus 100 according to the exemplary embodiment of the present invention are described below.

In FIGS. 3A and 3B, the photoconductive drum 1 rotates in the clockwise direction as indicated by arrows therein.

While the cleaning device 6 is in the non-cleaning mode of operation, the compression spring 13 exerts or provides the first pressure force applied to the point of application of the cleaning blade contact member 25. This may cause the cleaning blade supporting member 27 to be rotated in the clockwise direction, which can cause the cleaning blade 12 to contact onto the surface of the photoconductive drum 1. Concurrently, during the non-cleaning operation, the extension spring 18 exerts or provides the second pressure force applied to the cleaning blade separation arm 17. This may cause the leading edge of the cleaning blade separation arm 17 to downwardly press the blade separation member 26. That is, the second pressure force is applied to the point of application of the blade separation member 26.

Here, as previously described, the distance "L1", which is the distance from the rotation axis C of the cleaning blade supporting member 27 to the point of application of the cleaning blade contact member 25 to which the first pressure force exerted by the compression spring 13 is applied, and the distance "L2", which is the distance from the rotation axis C of the cleaning blade supporting member 27 to the point of application of the cleaning blade separation member 26 to which the second pressure force exerted by the cleaning blade separation arm 17 is applied have the relationship of L2>L1. Therefore, the second pressure force exerted by the extension spring 18 to apply to the point of application of the blade separation member 26 can easily be greater than the first pressure force exerted by the compression spring 13 to apply to the point of application of the cleaning blade contact member 25. Thus, the cleaning blade 12 can be separated from the surface of the photoconductive drum 1, which is in the regular non-cleaning operation, as shown in FIG. 3A.

After an image formed on the surface of the photoconductive drum 1 has been transferred onto the intermediate transfer belt 50 of the transfer device 5, the status of the cleaning device 6 may be changed from the non-cleaning operation and be ready to perform the cleaning operation for removing the residual toner on the surface of the photoconductive drum 1.

When the predetermined level of voltage is applied to the solenoid 20, the third pressure force may be exerted and the solenoid arm 21 may be pulled in the upward direction of FIG. 4A. The third pressure force may gradually be increased while transmitted, and may become greater than the second pressure force exerted by the extension spring 18 as shown in FIG. 4B. This may rotate the cleaning blade separation arm 17 about the pivoted shaft 19 in the counterclockwise direction so that the cleaning blade separation arm 17 can be moved to the position as shown in FIG. 3B.

The movement of the cleaning blade separation arm 17 disengages the cleaning blade separation member 26 from the leading edge of the cleaning blade separation arm 17, which may release the second pressure force applied to the point of application of the cleaning blade separation member 26 to rotate the cleaning blade supporting member 27 in the counterclockwise direction.

Under the above-described condition, the first pressure force applied to the point of application of the cleaning blade contact member 25 remains to rotate the cleaning blade supporting member 27 in the clockwise direction. Thus, the leading edge of the cleaning blade 12 can come to contact with the surface of the photoconductive drum 1 as shown in FIG. 3B. As previously described, the above-described contacting operation may be performed gradually because of the characteristics of the transmission of the third pressure force.

The cleaning device 6 maintains the status of the cleaning operation for a predetermined period of time for removing residual toner remaining on the surface of the photoconductive drum 1 and cleaning the photoconductive drum 1. After the predetermined period of time has elapsed, the image forming apparatus 100 stops applying the voltage to the solenoid 20, which can release the third pressure force exerted to pull up the cleaning blade separation arm 17 in the upward direction of FIGS. 4A and 4B. That is, the third pressure force exerted by the solenoid 20 is lost, the second pressure force exerted by the extension spring 18 is regained, and the first pressure force exerted by the compression spring 13 remains to be applied to the cleaning blade separation arm 17. With the above-described condition, the cleaning blade separation arm 17 may be moved to the position shown in FIG. 4B.

With the movement of the cleaning blade separation arm 17 to the position as shown in FIG. 4B, the cleaning blade separation member 26 and the leading edge of the cleaning blade separation arm 17 are engaged with each other. By engaging the cleaning blade separation member 26 with the cleaning blade separation arm 17, the amount of the first pressure force exerted by the compression spring 13 with respect to the cleaning blade contact member 25 becomes smaller. Accordingly, the second pressure force applied to the point of application of the cleaning blade separation member 26 may become greater than the first pressure force, which may rotate the cleaning blade supporting member 27 in the counterclockwise direction.

Since the distances "L1" and the distance "L2" have the relationship of L2>L1, the second pressure force exerted by the extension spring 18 to be applied to the point of application of the blade separation member 26 can easily be greater than the force exerted by the compression spring 13 to be applied to the point of application of the cleaning blade contact member 25. Thus, the cleaning blade 12 can be separated from the surface of the photoconductive drum 1, which is in the regular non-cleaning operation, as shown in FIG. 3A.

The cleaning device 6 may repeatedly perform the above-described cleaning and non-cleaning operations by turns at intervals of the predetermined period of time or under optional timing as needed. Thus, the cleaning device 6 may intermittently clean the surface of the photoconductive drum 1.

As described above, the cleaning device 6 of the image forming apparatus 100 according to the exemplary embodiment of the present invention includes the blade contact and separation mechanism 30 that may provide three different forces to control the movement of the cleaning blade 12 for removing residual toner on the surface of the photoconductive drum 1. Specifically, the blade contact and separation mechanism 30 may provide the first pressure force exerted by the compression spring 13 to be applied to the point of application of the cleaning blade contact member 25, the second pressure force exerted by the extension spring 18 to be applied to the point of application of the cleaning blade separation member 26 via the cleaning blade separation arm 17, and the third pressure force exerted by the solenoid 20 to be applied to the cleaning blade separation arm 17 via the solenoid arm 21.

When the first and second pressure forces are applied to the cleaning blade contact member 25 and the cleaning blade separation member 26, respectively, the second pressure force may become greater than the first pressure force based on the relationship of L2>L1. The above-described condition causes the cleaning blade supporting member 27 to angularly rotate about the rotation axis C in the counterclockwise direction, which may separate the cleaning blade 12 from the surface of the photoconductive drum 1. Thereby, the cleaning device 6 can stay in the status of the non-cleaning operation.

When the transfer device 5 completes the transfer operation, the cleaning device 6 turns on the power of the solenoid 20 to start the cleaning operation. As the third pressure force exerted by the solenoid 20 is applied to the cleaning blade separation arm 17 via the solenoid arm 21 that links the solenoid 20 and the extension spring 18 that is connected to the cleaning blade separation arm 17, the amount of the second pressure force may be gradually diminished or reduced. The above-described condition causes the cleaning blade supporting member 27 to angularly rotate about the rotation axis C in the clockwise direction, which may contact the cleaning blade 12 onto the surface of the photoconductive drum 1. Thereby, the cleaning device 6 can change the status thereof to the cleaning operation mode.

By gradually reducing the amount of the third pressure force, the stress which the cleaning blade 12 may cause to the surface of the photoconductive drum 1 when contacting the surface of the photoconductive drum 1 can be reduced, and the cleaning operation can be surely and reliably performed. This may contribute to the reduction or prevention of damage to the surface of the photoconductive drum 1, which can further reduce or prevent a defect in image.

Further, with the above-described structure based on the relationship of L2>L1, the size of the blade contact and separation mechanism 30 can be reduced, which can easily achieve stabilization of the blade contact and separation mechanism 30 while reducing the size and cost of the image forming apparatus 100.

Also, as described above, the cleaning blade 12 contacts the surface of the photoconductive drum 1 in the trailing direction, and includes a polishing agent at the leading edge thereof so as to expose the polishing agent with respect to the surface of the photoconductive drum 1.

By exposing the polishing agent with respect to the photoconductive drum 1, the cleaning blade 12 can remove toner and paper dust, which may cause a filming, and other foreign materials that are firmly attached to the surface of the photoconductive drum 1.

Further, by contacting the cleaning blade 12 with the gradually reduced force, the stress in which the photoconductive drum 1 may suffer during the cleaning operation may be reduced, which can further reduce or prevent a defect in the image produced.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

Obviously, numerous modifications and variations of the present invention are possible in light of the above teachings. It is therefore to be understood that within the scope of the appended claims, the invention may be practiced otherwise than as specifically described herein.

The invention claimed is:

1. A cleaning device, comprising:

a cleaning blade configured to remove toner adhered to a surface of an image bearing member; and a contact and separation mechanism configured to contact and separate the cleaning blade to and from the surface of the image bearing member, the contact and separation mechanism comprising:

a first force providing member configured to provide a first force to contact the cleaning blade onto the surface of the image bearing member;

a second force providing member configured to provide a second force to separate the cleaning blade from the surface of the image bearing member; and a third force providing member configured to provide a third force to change an amount of the second force exerted by the second force providing member.

2. The cleaning device according to claim 1, further comprising:

a first supporting member having a rotational axis and being configured to support the cleaning blade, wherein the cleaning blade is configured to angularly move about the rotational axis of the first supporting member.

3. The cleaning device according to claim 2, further comprising:

a contact member configured to receive the first force exerted by the first force providing member;

a first separation member configured to receive the second force exerted by the second force providing member; and a second separation member configured to receive the second force via the first separation member, wherein the contact and separation members have a relationship of L2>L1, where "L1" represents a distance from the rotational axis to a point of action of the contact member to which the first force is applied and "L2" represents a distance from the rotational axis to a point of action of the second separation member to which the second force is applied.

4. The cleaning device according to claim 3, wherein:

the first separation member is configured to receive the third force exerted by the third force providing member.

5. The cleaning device according to claim 1, wherein:

the first force providing member includes a compression spring;

the second force providing member includes an extension spring; and the third force providing member includes a solenoid.

6. The cleaning device according to claim 5, wherein:

when the cleaning blade is moved toward the image bearing member to contact with the surface of the image bearing member, a voltage is applied to the solenoid to gradually reduce an amount of the second force.

7. The cleaning device according to claim 6, further comprising:

a second supporting member having a shaft configured to connect the second and third force providing members with each other via said shaft.

8. The cleaning device according to claim 1, wherein:

the cleaning blade includes a polishing member.

9. The cleaning device according to claim 1, wherein:

the cleaning blade is configured to contact a leading edge thereof with the surface of the image bearing member in a direction following a rotation of the image bearing member.

10. An image forming apparatus, comprising:

an image bearing member configured to bear an image on a surface thereof; and a cleaning device configured to clean the image bearing member, the cleaning device comprising:

a cleaning blade configured to remove toner adhered on a surface of the image bearing member; and a contact and separation mechanism configured to contact and separate the cleaning blade to and from the surface of the image bearing member, the contact and separation mechanism comprising:

a first force providing member configured to provide a first force to contact the cleaning blade onto the surface of the image bearing member;

a second force providing member configured to provide a second force to separate the cleaning blade from the surface of the image bearing member; and a third force providing member configured to provide a third force to change an amount of the second force exerted by the second force providing member.

11. The image forming apparatus according to claim 10, wherein:

the cleaning device further comprises a first supporting member having a rotational axis and configured to support the cleaning blade; and the cleaning blade is configured to angularly move about the rotational axis of the first supporting member.

12. The image forming apparatus according to claim 10, wherein:

the cleaning device further comprises:

a contact member configured to receive the first force exerted by the first force providing member;

a first separation member configured to receive the second force exerted by the second force providing member; and a second separation member configured to receive the second force via the first separation member, wherein the contact and separation members have a relationship of L2>L1, where "L1" represents a distance from the rotational axis to a point of action of the contact member to which the first force is applied and "L2" represents a distance from the rotational axis to a point of action of the second separation member to which the second force is applied.

13. The image forming apparatus according to claim 12, wherein:

the first separation member is configured to receive the third force exerted by the third force providing member.

14. The image forming apparatus according to claim 10, wherein:

the first force providing member includes a compression spring;

the second force providing member includes an extension spring; and the third force providing member includes a solenoid.

15. The image forming apparatus according to claim 14, wherein:

when the cleaning blade is moved toward the image bearing member to contact with the surface of the image bearing member, the solenoid is applied with a voltage to gradually reduce the amount of the second force.

16. The image forming apparatus according to claim 15, wherein:

the cleaning device further comprises a second supporting member having a shaft configured to connect the second and third force providing members with each other via the shaft thereof.

17. The image forming apparatus according to claim 10, wherein:

the cleaning blade includes a polishing member.

18. The image forming apparatus according to claim 10, wherein:

the cleaning blade is configured to contact a leading edge thereof with the surface of the image bearing member in a direction following a rotation of the image bearing member.

19. The method of controlling a cleaning operation, comprising:

providing a first force exerted by a first force providing member and a second force exerted by a second force providing member so that a cleaning blade is separated from a surface of an image bearing member;

providing a third force exerted by a third force providing member so that an amount of the second force is reduced to gradually contact the cleaning blade with the surface of the image bearing member;

performing the cleaning operation for a predetermined period of time; and terminating the third force so that the cleaning blade is separated from the surface of the image bearing member.

* * * * *